US006933684B2

(12) United States Patent
Yang et al.

(10) Patent No.: US 6,933,684 B2
(45) Date of Patent: Aug. 23, 2005

(54) ELECTRONIC BALLAST USING CUT AND SAVE TECHNOLOGY

(75) Inventors: Kevin Jianwen Yang, Shanghai (CN); Haoran Zeng, Shanghai (CN); Songling Mao, Shanghai (CN)

(73) Assignee: Phi Hong Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 10/418,952

(22) Filed: Apr. 18, 2003

(65) Prior Publication Data

US 2003/0230990 A1 Dec. 18, 2003

(30) Foreign Application Priority Data

Apr. 19, 2002 (CN) ..... 02216946 U

(51) Int. Cl.[7] ..... H05B 41/16

(52) U.S. Cl. ..... 315/274; 315/279; 315/276; 315/209 R

(58) Field of Search ..... 315/274, 276, 315/278, 279, 219, 209 R, 224, 254, 256

(56) References Cited

U.S. PATENT DOCUMENTS

| | | | | |
|---|---|---|---|---|
| 4,258,295 A | | 3/1981 | Siglock | 315/189 |
| 4,425,530 A | | 1/1984 | Hammer et al. | 315/104 |
| 5,179,326 A | | 1/1993 | Nilssen | 315/106 |
| 5,565,740 A | * | 10/1996 | Hiramatsu et al. | 315/209 R |
| 5,586,016 A | | 12/1996 | Konopka et al. | 363/21 |
| 6,028,400 A | | 2/2000 | Pol et al. | 315/225 |
| 6,111,369 A | | 8/2000 | Pinchuk et al. | 315/307 |
| 6,169,669 B1 | * | 1/2001 | Choudhury | 363/37 |
| 6,300,726 B1 | | 10/2001 | Daub | 315/291 |
| 6,362,575 B1 | * | 3/2002 | Chang et al. | 315/224 |
| 6,680,585 B2 | * | 1/2004 | Trestman | 315/291 |
| 2002/0125834 A1 | * | 9/2002 | Shoji et al. | 315/224 |

FOREIGN PATENT DOCUMENTS

| | | |
|---|---|---|
| CN | 2209423 Y | 10/1995 |
| CN | 2278329 Y | 4/1998 |
| CN | 1046616 C | 8/1999 |
| DE | 38 41 095 A1 | 6/1990 |
| DE | 41 43 488 C2 | 11/1995 |

* cited by examiner

*Primary Examiner*—Tuyet Thi Vo
(74) *Attorney, Agent, or Firm*—Seed IP Law Group PLLC

(57) ABSTRACT

An ideal filament preheat technique in flourescence lamp is supplied by an adjusting circuit, an output circuit and a control circuit. At the filament preheating stage, an adequate preheating voltage is provided for the filament of the lamp tube, and the voltage cross over both ends of the lamp tube is reduced, thereby preventing glow current in preheating. When the preheating stage is finished and starting stage begins, the voltage between both ends of the lamp tube increases simultaneously, and then reaches a break-down voltage of the lamp tube, then the lamp tube is lit to enter a normal operation stage, the preheating voltage of the filament is cutoff under the control circuit, so as to save the filament power consumption. Therefore, the efficiency of the electronic ballast is improved, and the operation life of the flourescent lamp tube is extended.

17 Claims, 5 Drawing Sheets

ELECTRONIC BALLAST USING CUT AND SAVE TECHNOLOGY

BACKGROUND OF THE INVENTION

1. Field of the Invention

The present invention relates to electronic ballast circuitry for fluorescent lamps.

2. Description of the Related Art

A fluorescent lamp is a "green" (i.e., energy-saving and/or high-efficiency) light source, and advantageously has a color-temperature which is capable of being controlled. Fluorescent lamps have been widely used in various fields and become a preferred choice of man-made light sources in daily life. When such a high efficiency and high quality light source is widely used, not only is its energy and efficiency (for example, the development towards minimization, integration, digitalization, energy saving, and high efficiency), but also its operational life, is given much attention.

In the prior art, in order to increase the life of a fluorescent lamp tube, besides improving the quality of the lamp tube itself, two steps are generally performed, i.e., its filament is sufficiently preheated and the voltage between both ends of the lamp tube is reduced during its preheating.

In step 1, the filament of the lamp tube is sufficiently preheated immediately before lighting, and this facilitates the emitting of the electrons of the filament and the ionization breaking-down in the lamp tube so as to realize the glow starting function. However, the facts have proved that the preheating by excessive filament current causes the premature degradation of the filament and therefore reduces the life of the lamp tube, and a reasonable filament preheating current is necessary. In step 2, since a pulse voltage of typically 300 V or higher is applied to both ends of a lamp tube by common ballast during fluorescent lamp tube preheating, this easily tends to cause the so-called "glowing" phenomena. If the voltage applied to both ends of a lamp tube can be reduced during that period and the voltage at the moment of starting a lamp tube can be increased to ensure starting, the production of glow discharge can be prevented completely, i.e., the electrons emitted by a filament are prevented from sputtering under a high voltage and the lamp tube would not blackened over early, thereby lengthening the life of the lamp tube greatly.

The practice of the present invention is based on the fundamental considerations and constructions described above.

In order to increase the operation life of a fluorescent lamp tube, three processes have been researched, i.e., preheating, starting, and operating normally of lighting fluorescent lamp tube, and great attention is given to the filament preheating and the voltage applied to both ends of a lamp tube during its starting, therefore various methods and circuits based on concepts described above are proposed to slow the aging of the lamp tube.

In the prior art, a thermistor with positive temperature coefficient (PTC) is employed. A maximum filament preheating current is obtained by use of the thermistor connected between both ends of a lamp tube at the moment of tuning on a power supply, and with time elapsing, gradually becomes low due to the increasing resistance value with the rising temperature of the thermistor PTC, and at that time, the function of resonance capacitance in the circuit becomes obvious gradually, i.e., a Q value in the resonance circuit becomes greater gradually. When the voltage between both ends of the lamp tube is increased to a starting voltage, the lamp tube is lit. This is a simple and effective method, which has generally been employed in cheap electronic ballasts.

Furthermore, in electronic ballasts with high performance, an integrated circuit ("IC") is used as a driving control circuit. The IC has other functions, such as preheating time control, oscillation frequency setting, protection detecting, restarting function, and the like. This method can also reduce the voltage between both ends of a lamp tube during preheating.

By summarizing the present art conditions introduced above, the inventors have recognized the following facts: although the method is simple using a thermistor with positive temperature coefficient, due to influence of its performance, there are poor consistency and low reliability and a glow discharging phenomena is easily caused when the circuit is not properly adjusted. In addition, due to a heat effect of the thermistor, more than 1 W of power is consumed by electronic ballasts. By employing an IC as a driving control circuit, though there are realized powerful functions, simple adjustments, conveniently presetting preheat time, and other functions, it is difficult for a voltage output to a lamp tube to be reduced to an ideal condition due to a limited adjusting frequency (about two times), and especially for a lamp tube operated under a low tube voltage, the glow discharging phenomena occurs very easily. Furthermore, the cost of an IC and the complexity of its peripheral circuits also prevents it from being widely used. Therefore, the foregoing two methods cannot completely solve the problems of preheat starting and excessive tube voltage in starting. In the foregoing two methods, 2–4 W are consumed on every lamp tube after electronic ballasts operates normally, such that the efficiency of the whole device is reduced, the premature degradation of the filament is accelerated, and the life of the lamp tube is reduced.

An object of the present invention is to overcome the foregoing drawbacks presented in the prior art.

An electronic ballast manufactured based on the disclosed CUT & SAVE technology can nearly perfectly realize the functions of both solving filament preheating and reducing tube voltage during preheating, and a preheating voltage applied to a filament can be removed after the lamp tube is started and operates normally.

The disclosed CUT & SAVE technology achieves energy saving by performing corresponding processing in different stages of operation with the use of new concepts and technologies, and on the basis of energy saving, the whole operational performance of electronic ballasts are improved so as to prevent the glow discharging phenomena from occurring and to greatly increase safety thereof.

BRIEF SUMMARY OF THE INVENTION (1) In order to avoid the phenomena of an over high voltage of a fluorescent lamp tube in preheating, there is provided a new method capable of preventing the glow discharging phenomena of fluorescent lamp tubes from occurring. The sputtering phenomena of electrons emitted by a filament under high voltage is thereby avoided.

(2) The filament in a fluorescent lamp tube is preheated sufficiently.

(3) After a fluorescent lamp operates normally, useless power consumed on its filament is reduced to improve the efficiency of electronic ballast.

Thus, an energy saving and high efficient electronic ballast, which can extend life of a fluorescent lamp, can be produced.

One embodiment of the present invention uses the following circuit to overcome its technical problems: in an electronic ballast comprising an electromagnetic compatible filter circuit (1), a rectifier circuit (2), a power factor correcting circuit (3), a DC filter circuit (4), a DC/AC converter circuit (5), and an output circuit (7) connected successively, there is further included: an adjusting circuit (6), in which a primary winding (N21) of a transformer (T2) is connected in series to a primary winding (N11) of a transformer (T1) in the output circuit (7), and a secondary winding (N22) of the transformer (T2) is connected in series to a secondary winding (N12) of the transformer (T1) in the output circuit (7); and a control circuit (8), in which a primary winding (N31) of a transformer (T3) is connected in series to a group of filaments of a fluorescent lamp tube (9) and a filament winding (N24) of the transformer (T2) in the adjusting circuit (6), and a TRIAC is connected in parallel to the secondary winding (N22) of the transformer (T2) in the adjusting circuit (6), and in which a secondary winding (N32) of the transformer (T3) is connected with a delay circuit comprising a rectifying diode (D2), resistors (R1, R2) and a capacitor (C3), and the delay circuit is connected to a gate (G) of the TRIAC via a trigger diode (D1).

A filament is given a fixed voltage and preheated in a set time after a power supply of electronic ballast is turned ON. Since the voltage output to a lamp tube is the difference between voltages on the secondary windings of both the output transformer T1 and other transformer T2, the lamp tube voltage can remain low (e.g., less than 50 V) during the preheating of the lamp tube. After completing preheating, the control circuit can cause the lamp tube voltage to rise instantly so as to light the lamp tube. At the same time as the lighting of the lamp tube, the control circuit causes the voltage applied to the filament of the lamp tube to be removed, so that the power consumption on the filament is avoided to improve the whole efficiency of the electronic ballast. Accordingly, the present invention not only realizes the ideal starting of the electronic ballast, extends the life of the lamp tube, and achieves the energy saving purpose, but also improves safety performance. Therefore, the output voltage is less than 50 V even under the tuning ON state without a lamp tube.

DETAILED DESCRIPTION OF THE INVENTION

Figure 1:
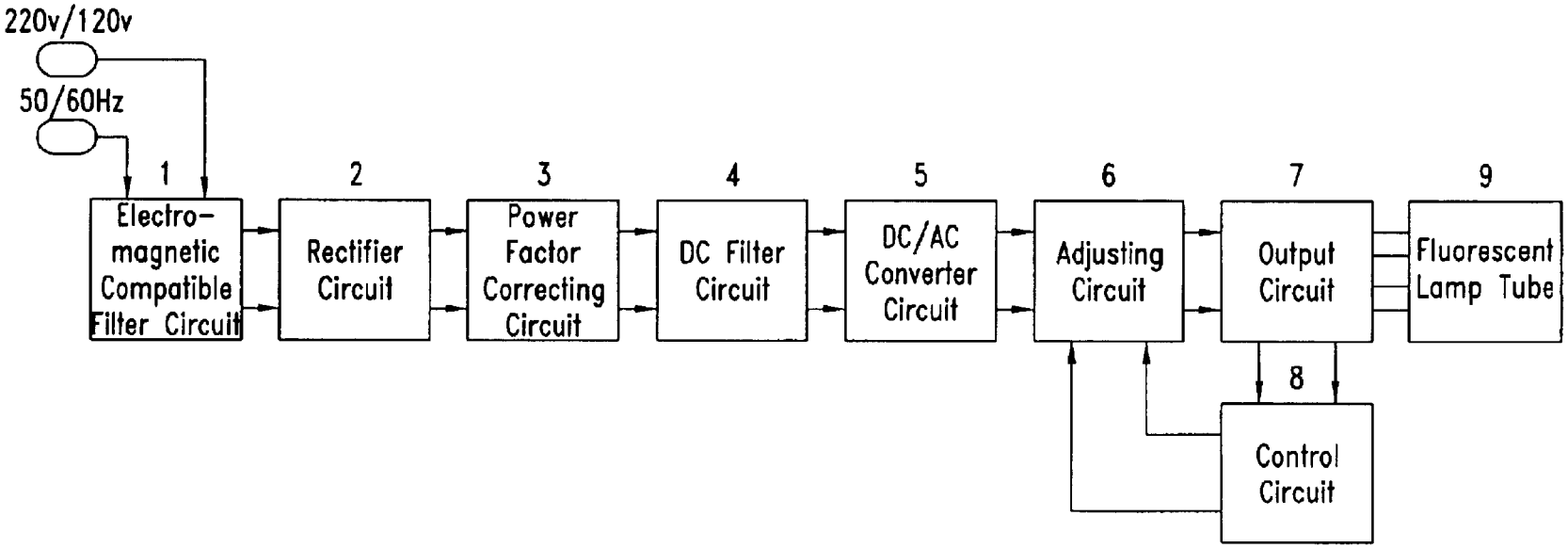
FIG. 1 is a block diagram of a circuit structure according to one illustrated embodiment of the invention.

As shown in FIG. 1, an electronic ballast includes an electro-magnetic compatible filter circuit 1, a rectifier circuit 2, a power factor correcting circuit (PFC) 3, a DC filter circuit 4, a DC/AC converter circuit 5, an adjusting circuit 6, an output circuit 7, and a control circuit 8 connected successively.

Figure 2A:
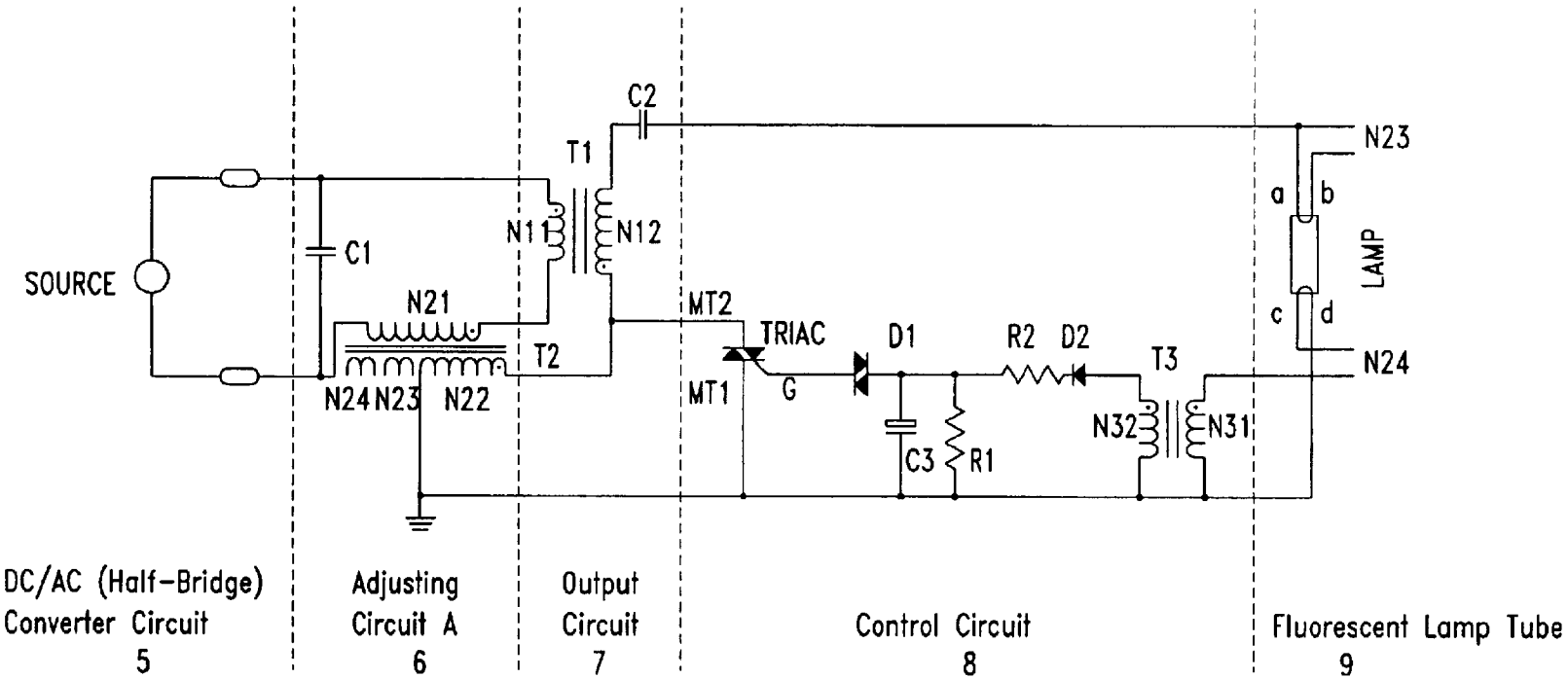
FIGS. 2*a* and 2*b* are electric schematic diagrams of illustrated embodiments the invention.

As shown in FIG. 2*a*, a primary winding N21 of a transformer T2 in the adjusting circuit 6 is connected in series to a primary winding N11 of a transformer T1 in the output circuit 7. In particular, the same polarity end of the primary winding N21 of the transformer T2 is connected to the different polarity end of the primary winding N11 of the transformer T1 in the output circuit 7, and both the other end of the primary winding N21 of the transformer T2 and the other end of the primary winding N11 of the transformer T1 are connected to output ends port 1 and port 2 of the DC/AC converter circuit 5 respectively, with a resonant capacitor C1 being connected between the output ends of the DC/AC converter circuit 5.

A secondary winding N22 of the transformer T2 in the adjusting circuit 6 is connected in series to a secondary winding N12 of the transformer T1 in the output circuit 7. In particular, the same polarity end of the secondary winding N22 of the transformer T2 is connected to the same polarity end of the secondary winding N12 of the transformer T1 in the output circuit 7, the other end of the secondary winding N22 of the transformer T2 in the adjusting circuit 6 is grounded, and the other end of the secondary winding N12 of the transformer T1 in the output circuit 7 is connected in series to a current limiting capacitor C2 and then connected with an end of a filament of a fluorescent lamp tube. Furthermore, two groups of filament voltage windings N23 and N24 are provided on the transformer T2 in the adjusting circuit 6, with winding N23 being connected with filaments a and b of the fluorescent lamp tube, and with winding N24 being connected with filaments c and d of the fluorescent lamp tube after being connected in series to winding N31 of transformer T3.

If the ballast is designed to drive multiple lamp tubes, additional filament windings can be added to T2.

These additional filament windings are operated in the same way as winding N23,N34.

A primary winding N31 of a transformer T3 in the control circuit 8 is connected in series to a group of filaments c and d of the fluorescent lamp tube 9 and the filament winding N24 of the transformer T2 in the adjusting circuit 6. A TRIAC is connected in parallel to the secondary winding N22 of the transformer T2 in the adjusting circuit 6, and a secondary winding N32 of the transformer T3 is connected with a delay trigger circuit comprising a rectifying diode D2, resistors R1 and R2, and a capacitor C3, and the trigger delay circuit is connected to a gate G of the TRIAC via a trigger diode D1.

The operation principles of the invention will further be analyzed in following.

1. Preheating Stage:

A high voltage square wave with high frequency, output by the DC/AC converter circuit 5, is applied to a parallel resonant circuit, which consists of an inductor including the winding N11 in the transformer T1 as well as the winding N21 in the transformer T2, and of the resonant capacitor C1.

The output transformer T1 is used to provide energy output for the fluorescent lamp tube 9 in starting and operating. The transformer T2 functions as the corresponding control and adjustment of the fluorescent lamp tube operating in different periods. Since the winding N21 in the transformer T2 is connected in series with the winding N11 in the transformer T1, and a part of the input voltage is shared by the winding N21 of the transformer T2, windings N23 and N24 then take a part of energy as the preheating voltage provided for the lamp tube filament during the preheating of the fluorescent lamp tube. At the same time, since the same polarity ends of the winding N11 in the transformer T1 and the winding N21 in the transformer T2 are connected, the total voltage of the output end is always the difference between the winding N12 and the winding N22, and the output voltage value of the winding N12 can be controlled by the proper adjustment of the turn number of the winding N22. This voltage is present between both ends of the lamp tube by coupling with the current limiting capacitor C2 and becomes a low voltage less than 50 V. Tests have proven that so low a voltage never causes the lamp tube to produce glow discharge in preheating the lamp tube, and at that time, the current of the lamp tube is zero. The disclosed circuit can thereby realize the following function: during the preheating stage of the lamp tube, a preheating voltage can be provided for the filament, and also the tube voltage between the both ends of the lamp tube can be made to be low.

At the moment of turning ON the power supply, the voltage of the winding N24 of the transformer T2 is applied to the winding N31 of the transformer T3 via filaments c and d, and the voltage of the winding N32 of the transformer T3, rectified by the rectifying diode D2, is applied to the delay circuit comprising the resistor R1 and R2, and the capacitor C3 (this circuit is used to control the preheating time of the lamp tube, and the time may be selected between, for example, 0.4 s–1.5 s). With charging for the capacitor C3 continually, when the voltage between its two ends reaches the breakdown voltage (generally between approximately 28 V and 34 V) of the trigger diode D1, the TRIAC becomes conductive and short-circuits the winding N22 of the transformer T2, and at that time, the lamp tube rapidly proceeds to a starting stage, described below.

2. Starting Stage

Due to the short-circuit of the winding N22 of the transformer T2, the voltages on all windings of the transformer T2 are reduced to approximately zero, i.e., the voltage applied to the filament of the fluorescent lamp tube is removed, and the voltage of the winding N21 of the transformer T2 is reduced to approximately zero, so that the square wave with high voltage and high frequency, outputted from the DC/AC converter circuit 5, is all applied to the winding N11 of the transformer T1 to cause the voltage of the winding N12 of the transformer T1 to be all applied to the fluorescent lamp tube. At that time, under the effect of the resonant capacitor C1, the voltage, produced by the winding N12 of the transformer T1, causes the fluorescent lamp tube to be lit.

3. Normal Operating Stage

When the fluorescent lamp tube 9 is lit to operate normally, since the equivalent circuit of the fluorescent lamp tube 9 corresponds to a circuit with a resistor and a voltage stabilizing diode in series and is a constant-voltage device, in the output circuit 7, a current limiting capacitor C2 is connected in series. At this time, since the filament voltage is removed, the filament power of every tube is reduced normally by approximately 2–4 W so as to realize the CUT&SAVE technology of filament preheat completely and improve the whole efficiency of the electronic ballast. In addition, it is noted that since the saturation voltage drop of the TRIAC is only about 1 V, the operation of the main circuit is not influenced.

A DC/AC converter circuit constituted of half-bridge type is introduced above, but in fact, the above described solution is completely applicable to any other type of (drive) converter circuits, and the principle of a converter circuit constituted of push-pull type (see FIG. 2*b*) is described below as just one possible embodiment.

Figure 2B:
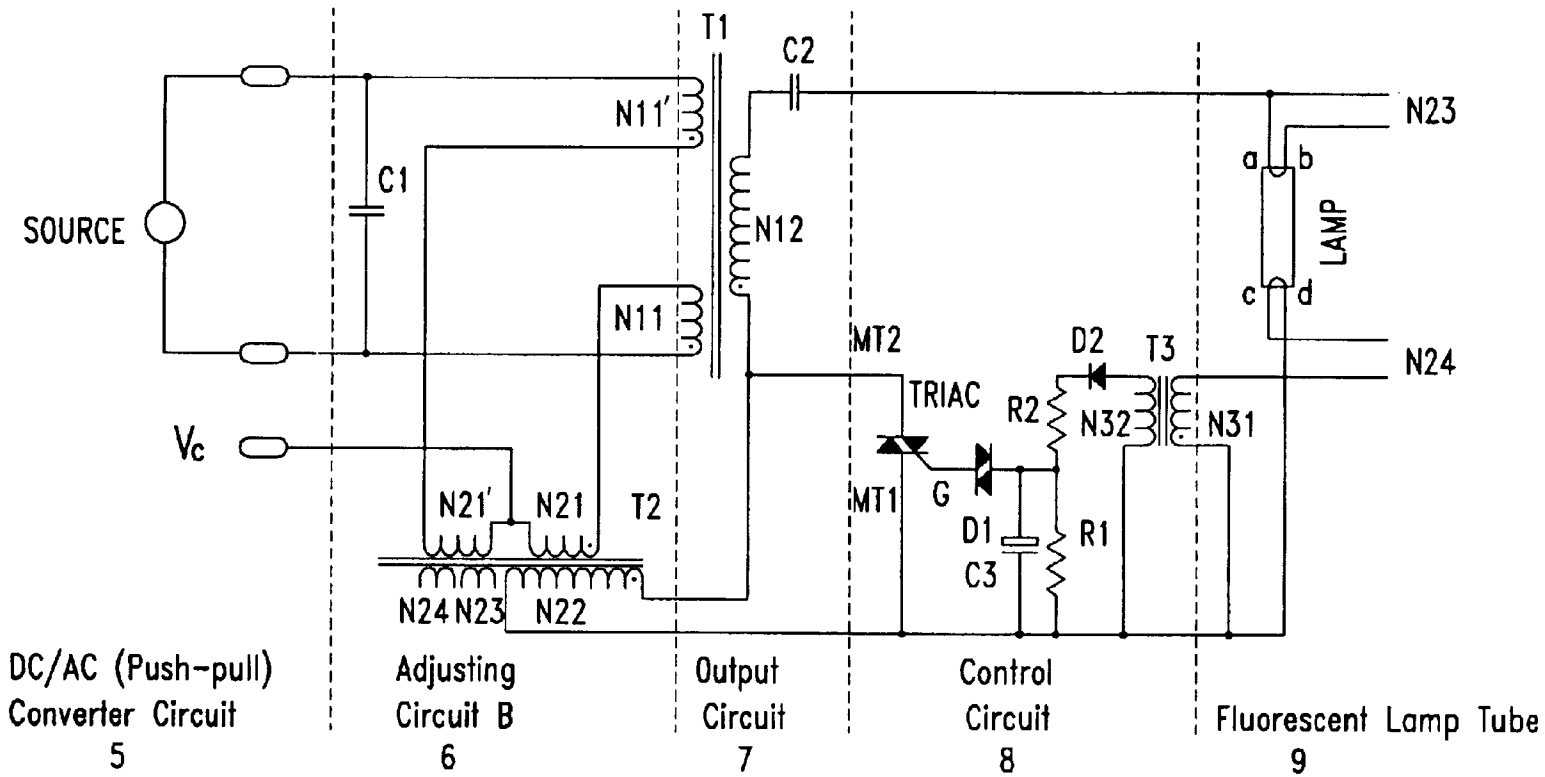

By comparing FIGS. 2*a* and 2*b*, we can clearly see that compared to the converter circuit constituted of half bridge type, the converter circuit constituted of push-pull type is provided with a winding N11' added to the transformer T1 and a winding N21' added to the transformer T2, and both windings provide respective paths in two positive and negative half-cycles so as to complete a combining whole waveform output of the winding N12 of the transformer T1.

The particular implementing .method is referred to FIG. 2*b*.

The same polarity end of the winding N21' of the transformer T2 is connected with the different polarity end of the winding N21, and their common end is connected with the output port 3 of the DC/AC (push-pull) converter circuit. The different polarity end of the winding N21' of the transformer T2 is connected with the same polarity end of the winding N11' of the transformer T1. The different polarity end of the winding N11' of the transformer T1 is connected with one end of the capacitor C1 and the output port 1 of the DC/AC (push pull) converter circuit, and the same polarity end of the winding N11 of the transformer T1 is connected with the other end of the capacitor C1 and the output port 2 of the DC/AC (push-pull) converter circuit. The different polarity end of the winding N11 of the transformer T1 is connected with the same polarity end of the winding N21 of the transformer T2.

Its principle is described simply below:

Reference to FIG. 2*b*, a positive DC high voltage Vc, via port 3, through the windings N21, N21' of the transformer T2 and the windings N11, N11' of the transformer T1, and by way of port 1 and port 2 respectively, is connected to a collector of a power transistor (or a drain of a field-effect MOS transistor).

Under the control of driving voltage respectively applied to corresponding gate electrode (base or grid electrode), the corresponding power transistor is operated in turn (turn ON or turn OFF). Since two windings of transformer T1 are connected in opposite direction and are turned on in turn within one oscillation cycle, the output winding thereof N12 combines one complete AC voltage in one cycle.

The other principles and processes are the same as those of the (half bridge) DC/AC converter circuit and their description is omitted here since they will be readily apparent to one skilled in the art.

The preferred embodiments of the invention realize low voltage preheating start of the both ends of a fluorescent lamp tube to lengthen the operation life of the lamp tube, and after starting, remove all filament voltage to improve the efficiency of the electronic ballast. This has better practice value and economic effects.

Figure 3:
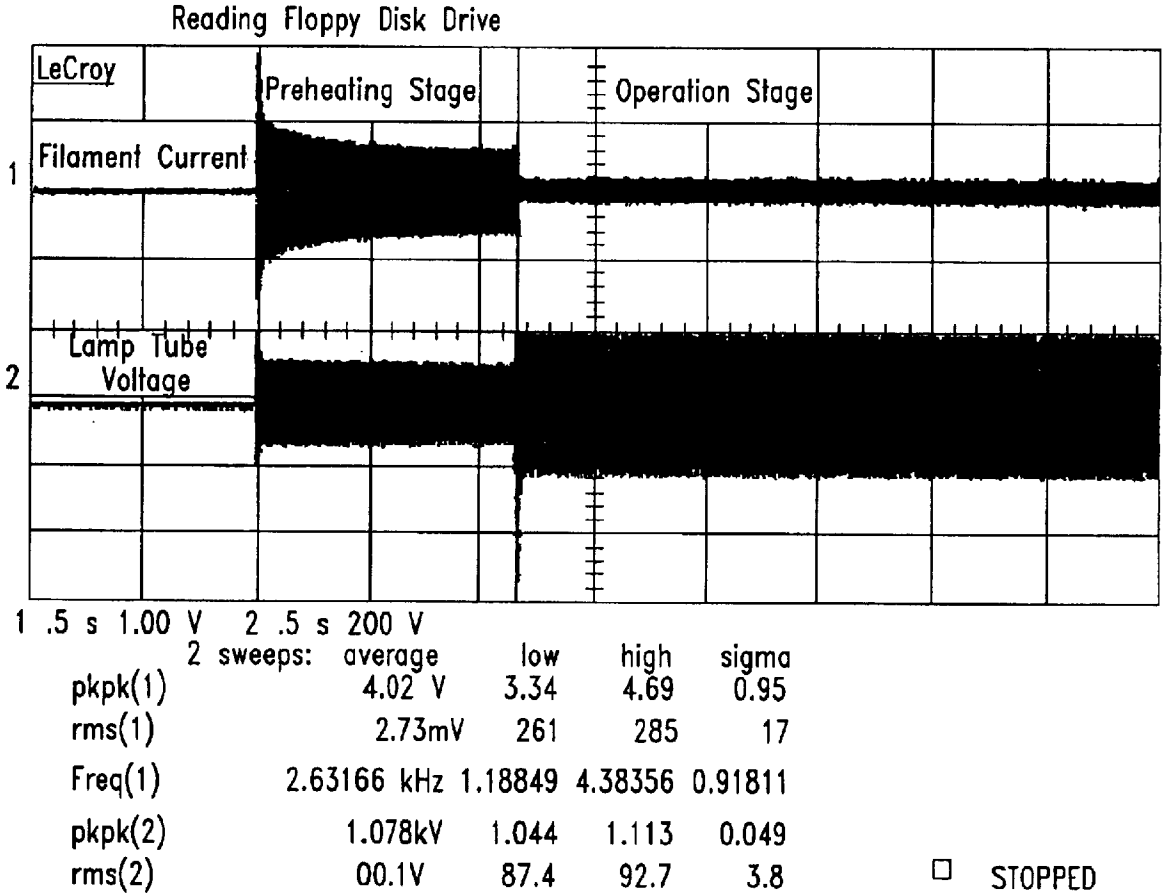
FIG. 3 shows waveform diagrams of a filament current and a lamp tube voltage when beginning to preheat according to the illustrated embodiment of the invention.
Figure 4:
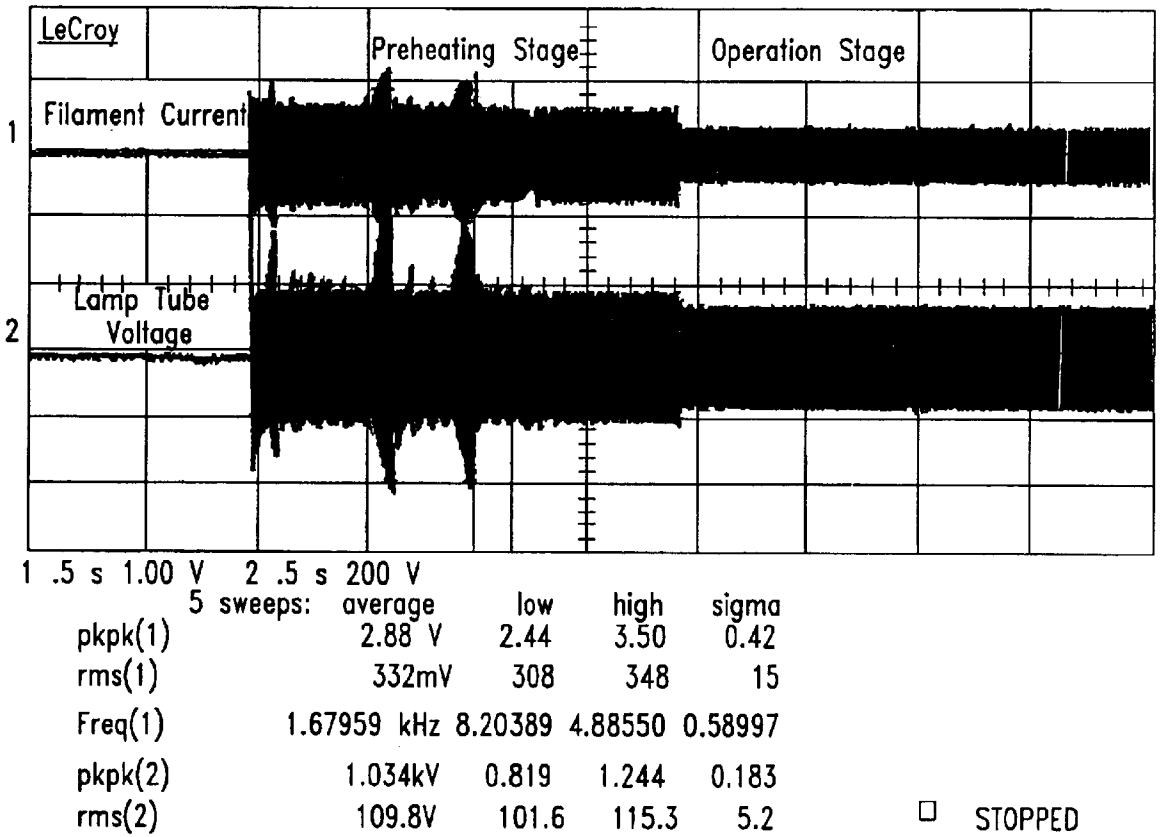
FIG. 4 shows wave form diagrams of a filament current and a lamp tube voltage when other electronic ballasts begin to preheat.

Referring to FIGS. 3 and 4, by comparing electronic ballast of the invention with that of the prior art, it can be clearly seen that in the filament currents before and after starting in the invention, the latter is zero, and the tube voltage in preheating is not as high as half of the operation voltage, i.e., less than 50 V. However, the lamp tube with electronic ballast in the prior art has a higher tube voltage in the stage of the filament preheating, and has a great filament current when operating normally.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the adjusting circuit, the output circuit and the control circuit are coupled between the DC/AC converter circuit and a lamp tube, and the adjusting circuit, the output circuit and the control circuit are configured to limit a voltage across the lamp tube and provide a preheating voltage in a filament preheating stage, and to simultaneously provide a lamp lit voltage and cutoff the preheating voltage after the preheating stage and wherein the DC/AC converter circuit is half-bridge type converter circuit, in which a same polarity end of a primary winding of a transformer in the adjusting circuit is connected in series with a different polarity end of a primary winding of a transformer in the output circuit.

2.An electronic ballast according to claim 1, wherein a same polarity end of the secondary winding of the transformer in the adjusting circuit is connected in series with a same polarity end of a secondary winding of the transformer in the output circuit.

3. An electronic ballast according to claim 1, wherein a TRIAC is connected in parallel between both ends of the secondary winding of the transformer in the adjusting circuit.

4. An electronic ballast according to claim 1, wherein a primary winding of a transformer in the control circuit is connected in series with a group of filaments, and then connected in parallel to a filament winding of the transformer in the adjusting circuit; one end of a secondary winding of a transformer in the control circuit is connected with a delay trigger circuit comprising a diode, resistors and a capacitor in the control circuit, and the other end thereof is connected to a virtual ground; the output of the delay trigger circuit is connected with a gate of the TRIAC via a trigger diode.

5. An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the adjusting circuit, the output circuit and the control circuit are coupled between the DC/AC converter circuit and a lamp tube, and the adjusting circuit, the output circuit and the control circuit are configured to limit a voltage across the lamp tube and provide a preheating voltage in a filament preheating stage, and to simultaneously provide a lamp lit voltage and cutoff the preheating voltage after the preheating stage and wherein the DC/AC converter circuit is push-pull type converter circuit, in which a different polarity end of a first primary winding and a same polarity end of a second primary winding of a transformer in the adjusting circuit are connected in series, with their connection point being connected to a positive high voltage source; the other end of the first primary winding of the transformer in the adjusting circuit is connected with a different polarity end of a first primary winding of a transformer in the output circuit; and the other end of the second primary winding of the transformer in the adjusting circuit is connected with a same polarity end of a second primary winding of the transformer in the output circuit.

6. An electronic ballast according to claim 5, wherein a same polarity end of the secondary winding of the transformer in the adjusting circuit is connected in series with a same polarity end of a secondary winding of the transformer in the output circuit.

7. An electronic ballast according to claim 5, wherein a TRIAC is connected in parallel between both ends of the secondary winding of the transformer in the adjusting circuit.

8. An electronic ballast according to claim 5, wherein a primary winding of a transformer in the control circuit is connected in series with a group of filaments, and then connected in parallel to a filament winding of the transformer in the adjusting circuit; one end of a secondary winding of a transformer in the control circuit is connected with a delay trigger circuit comprising a diode, resistors and a capacitor in the control circuit, and the other end thereof is connected to a virtual ground; the output of the delay trigger circuit is connected with a gate of the TRIAC via a trigger diode.

9. An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the adjusting circuit, the output circuit and the control circuit are coupled between the DC/AC converter circuit and a lamp tube, and the adjusting circuit, the output circuit and the control circuit are configured to limit a voltage across the lamp tube and provide a preheating voltage in a filament preheating stage, and to simultaneously provide a lamp lit voltage and cutoff the preheating voltage after the preheating stage and wherein a same polarity end of secondary winding of a transformer in the adjusting circuit is connected with a same polarity end of a secondary winding of a transformer in the output circuit.

10. An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the adjusting circuit, the output circuit and the control circuit are coupled between the DC/AC converter circuit and a lamp tube, and the adjusting circuit, the output circuit and the control circuit are configured to limit a voltage across the lamp tube and provide a preheating voltage in a filament preheating stage, and to simultaneously provide a lamp lit voltage and cutoff the preheating voltage after the preheating stage and wherein a TRIAC is connected in parallel between both ends of a secondary winding of a transformer in the adjusting circuit and a different polarity end of the secondary winding of the transformer in the adjusting circuit is connected to a virtual ground.

11. An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the adjusting circuit, the output circuit and the control circuit are coupled between the DC/AC converter circuit and a lamp tube, and the adjusting circuit, the output circuit and the control circuit are configured to limit a voltage across the lamp tube and provide a preheating voltage in a filament preheating stage, and to simultaneously provide a lamp lit voltage and cutoff the preheating voltage after the preheating stage and wherein a primary winding of a transformer in the control circuit is connected in series with a group of filaments, and then connected in parallel to a filament winding of a transformer in the adjusting circuit; one end of a secondary winding of a transformer in the control circuit is connected with a delay trigger circuit comprising a diode, resistors and a capacitor in the control circuit, and the other end thereof is connected to a virtual ground; the output of the delay trigger circuit is connected with a gate of a TRIAC via a trigger diode.

12. An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit and a control circuit, wherein the electronic ballast is configured to limit glow discharge by controlling a voltage across a lamp tube and to provide a preheating voltage in a filament preheating stage, and to provide a lamp lit voltage and discontinue the preheating voltage after the preheating stage and wherein the DC/AC converter circuit is half-bridge type converter circuit, in which a first polarity end of a primary winding of a transformer in the adjusting circuit is connected in series with a different polarity end of a primary winding of a transformer in the output circuit.

13. An electronic ballast for a fluorescent lamp tube, comprising;

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the electronic ballast is configured to limit glow discharge by controlling a voltage across a lamp tube and to provide a preheating voltage in a filament preheating stage, and to provide a lamp lit voltage and discontinue the preheating voltage after the preheating stage and wherein the DC/AC converter circuit is push-pull type converter circuit, in which a first polarity end of a first primary winding and a second polarity end of a second primary winding of a transformer in the adjusting circuit are connected in series, with their connection point being connected to a positive high voltage source; the other end of the first primary winding of the transformer in the adjusting circuit is connected with a first polarity end of a first primary winding of a transformer in the output circuit; and the other end of the second primary winding of the transformer in the adjusting circuit is connected with a second polarity end of a second primary winding of the transformer in the output circuit.

14. An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the electronic ballast is configured to limit glow discharge by controlling a voltage across a lamp tube and to provide a preheating voltage in a filament preheating stage, and to provide a lamp lit voltage and discontinue the preheating voltage after the preheating stage and wherein a first polarity end of a secondary winding of a transformer in the adjusting circuit is connected with a first polarity end of a secondary winding of a transformer in the output circuit.

15. An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the electronic ballast is configured to limit glow discharge by controlling a voltage across a lamp tube and to provide a preheating voltage in a filament preheating stage, and to provide a lamp lit voltage and discontinue the preheating voltage after the preheating stage wherein a TRIAC is connected in parallel between both ends of a secondary winding of a transformer in the adjusting circuit.

16. Amended) An electronic ballast for a fluorescent lamp tube, comprising:

an electro-magnetic compatible filter circuit;

a rectifier circuit;

a power factor correcting circuit;

a DC filter circuit;

a DC/AC converter circuit;

an adjusting circuit;

an output circuit; and a control circuit, wherein the electronic ballast is configured to limit glow discharge by controlling a voltage across a lamp tube and to provide a preheating voltage in a filament preheating stage, and to provide a lamp lit voltage and discontinue the preheating voltage after the preheating stage and wherein a primary winding of a transformer in the control circuit is connected in series with a group of filaments, and connected in parallel to a filament winding of a transformer in the adjusting circuit; one end of a secondary winding of a transformer in the control circuit is connected with a delay trigger circuit comprising a diode, resistors and a capacitor in the control circuit, and the other end thereof is connected to a virtual ground; and the output of the delay trigger circuit is connected with a gate of a TRIAC via a trigger diode.

17. An electronic ballast for a fluorescent lamp tube, comprising:

an electro-magnetic compatible filter circuit;

a rectifier circuit;

a power factor correcting circuit;

a DC filter circuit;

a DC/AC converter circuit; and means for providing a preheating voltage and inhibiting a glow discharge in a preheating stage, and for providing a lamp lit voltage and discontinuing the preheating voltage after the preheating stage wherein the means for providing a preheating voltage and inhibiting a glow discharge in a preheating stage, and for providing a lamp lit voltage and discontinuing the preheating voltage after the preheating stage comprises: an adjusting circuit and an output circuit, wherein an end of a secondary winding of a transformer in the adjusting circuit is connected with a same polarity end of a secondary winding of a transformer in the output circuit.

* * * * *